US005954548A

United States Patent [19]

Stabroth

[11] Patent Number: 5,954,548

[45] Date of Patent: Sep. 21, 1999

[54] CONTACT ELEMENTS AND PLUG-IN CONNECTORS, IN PARTICULAR FOR CABLE HARNESSES

[75] Inventor: Waldemar Stabroth, Eckental, Germany

[73] Assignee: Framatome Connectors International, Courbevoie, France

[21] Appl. No.: 08/986,414

[22] Filed: Dec. 8, 1997

[30] Foreign Application Priority Data

Dec. 9, 1996 [DE] Germany ..... 196 51 120

[51] Int. Cl.[6] ..... H01R 4/48

[52] U.S. Cl. ..... 439/839; 439/748

[58] Field of Search ..... 439/825, 828, 439/839, 851, 746, 748

[56] References Cited

U.S. PATENT DOCUMENTS 4,010,993 3/1977 Hohenberger et al. .
5,240,439 8/1993 Egenolf ..... 439/639
5,266,056 11/1993 Baderschneider et al. .
5,281,175 1/1994 Chupak et al. ..... 439/852
5,607,328 3/1997 Joly ..... 439/851
5,695,368 12/1997 Joly et al. ..... 439/839

FOREIGN PATENT DOCUMENTS 0 700 124 A2 3/1996 European Pat. Off. ..... H01R 13/428

*Primary Examiner*—Gary F. Paumen
*Assistant Examiner*—Briggitte Hammond
*Attorney, Agent, or Firm*—Pollock, Vande Sande

[57] ABSTRACT

Bush-like and plug-like contact elements and plug-in connectors which contain such contact elements. The contact elements have, on one front box section which is provided for insertion into a chamber of a plug-in connector body, a first latching element which can make a latching connection with a complementary second latching element of the plug-in connector body, in order to hold the contact element non-displaceably in the body. The first latching element is arranged on a flexible tongue of the box section, which tongue can move perpendicularly with respect to the plugging-in direction in order to release the latching connection.

16 Claims, 4 Drawing Sheets

CONTACT ELEMENTS AND PLUG-IN CONNECTORS, IN PARTICULAR FOR CABLE HARNESSES

FIELD OF THE INVENTION

The present invention relates to contact elements and plug-in connectors in which such elements are used and which are suitable in particular for equipping cable harnesses and generally for applications in which multi-conductor cables have to be prepared.

BACKGROUND OF THE INVENTION

An example of a contact bush and a plug-in connector according to the prior art is described in applicant's U.S. Pat. No. 4,834,681. This known contact bush comprises a front box section which is inserted into a chamber of a plug-in connector body and held therein, and a rear connection section to which an electric lead can be attached, for example by crimping. A window-shaped cut-out in the rigid box section constitutes a first latching element. A flexible tongue with a lug which forms a complementary second latching element is constructed in one piece with an insulator body of the plug-in connector. Both can make a latching connection by means of which the contact element is non-displaceably held in the body. If a cable is to be provided with plugs using such a contact element, the ends of the individual conductors of the cable are first fitted with contact elements and these are then inserted into the insulator body from the cable outlet side and latched there.

Such a procedure is practical and efficient if the number of conductors to be fitted per cable is low and if the risk of a contact element being inadvertently inserted into the wrong chamber of the body can be kept low by color coding of the conductors or the like.

However, in particular in the automobile industry the complexity of cabling has recently increased considerably. It is therefore necessary to a greater extent to fit plug-in connectors to cables with a large number of conductors or to cable harnesses with a complex branching pattern. When this is being done, only a single error is often sufficient to make the entire cable or cable harness unusable, since, even if the error can be localized, it is often impossible to eliminate it. After the contact element has been plugged into the insulator body, the latching elements are no longer accessible and can no longer be separated from one another, so that it is virtually impossible to release the incorrectly inserted contact elements from the insulator body. If this is in fact achieved, it is only at the price of damaging or destroying the latching elements. In this context, the lug and the tongue are particularly at risk since they are composed, like the insulator body, of plastic and are therefore substantially softer than the metal of the bush.

In particular, if the length of the cables is subjected to only small tolerances, it is often also impossible to simply cut off an incorrectly fitted plug-in connector and put a new one in its place.

If it is assumed that in a cable harness with, for example, 100 connections the probability of incorrectly fitting a single one of these connections is only 1 per thousand, this means that 10% of all completed cable harnesses are faulty. If it is also considered that in the case of multi-conductor connections the effectiveness of the prevention of errors by color coding the conductors, or in some other way, is smaller as their number becomes larger, it becomes obvious that there is a considerable requirement for contact elements or plug-in connectors which permit errors to be easily corrected even after fitting.

SUMMARY OF THE INVENTION

This requirement is met in accordance with the invention by virtue of the fact that a flexible tongue is provided on the contact element defined at the beginning, on which tongue the first latching element is arranged and which can be moved perpendicularly with respect to the plugging direction, in order to release the latching connection. Since this tongue is composed of metal, it is substantially more sturdy than the corresponding tongue on the insulator body of a plug-in connector.

In order to be able to make the tongue in the plug-in connector conveniently accessible, there is provision for it to extend in the plugging direction and to have a free end approximately at the level of the front end of the box section. The tongue is preferably curved about an axis which is parallel to its longitudinal direction, so that it is not only satisfactorily flexible but also is rigid enough to prevent inadvertent release of the latching connection.

The tongue can expediently be provided at its free end with a sloping surface which extends forward and inward and is accessible with a tool from one side of the plug-in connector, preferably the contact side, and can be pressed inward in order to release the latching connection.

The box section of the contact element can be plugged into a stiff sleeve which can serve several purposes i.e., it both contributes to the stiffening of the entire box section and it prevents the tongue from being plastically deformed, for example when the contact element is plugged into its chamber, and thus becoming unusable. A further function of the sleeve may be to protect the plug-in connector itself against damage when the contact element is inserted. In particular, if a seal is provided at the cable outlet side, through which seal the contact element has to be pushed, it is appropriate to provide the sleeve with rounded corners, in order that, the tongue can be moved and exert its locking function despite the presence of the sleeve, a cut-out, through which the latching elements can engage, is provided in the area of the sleeve located opposite the tongue. This cut-out should be narrower than the tongue itself so that its edges remain effectively protected.

The contact element according to the invention can be either a contact bush or a plug. In the case of a contact bush, it is preferred, for reasons of stability, to construct the tongue and contact springs so that they clamp in a pin, inserted into the bush, on different walls of the box section, in particular on an upper wall and two side walls. In this context, it is expedient if the contact springs are produced in the usual way by means of an essentially U-shaped punching operation, in which case, however, a log of the U extending between a side wall and one upper wall is lengthened as far as the front end of the box section, since, in this way, the tongue is produced, as it were, as a byproduct during the punching of the contact springs.

The plug-in connector according to the invention comprises a body in which at least one contact element according to the invention is received in a chamber and which has a passage through which a tool can be pressed on to the tongue in order to release the latching connection. The passage may be, for example, a guide cut-out which opens on to the flexible tongue at an angle. Preferably, in particular if a plurality of rows of chambers are provided, the passage extends parallel to the plugging direction and guides the tool on to the sloping surface which moves inwards under its pressure and releases the latching connection.

BRIEF DESCRIPTION OF THE DRAWINGS

Further features and advantages of the inventions will emerge from the following description with reference to the drawing figures, in which.

DETAILED DESCRIPTION OF PREFERRED EMBODIMENT

Figure 1:
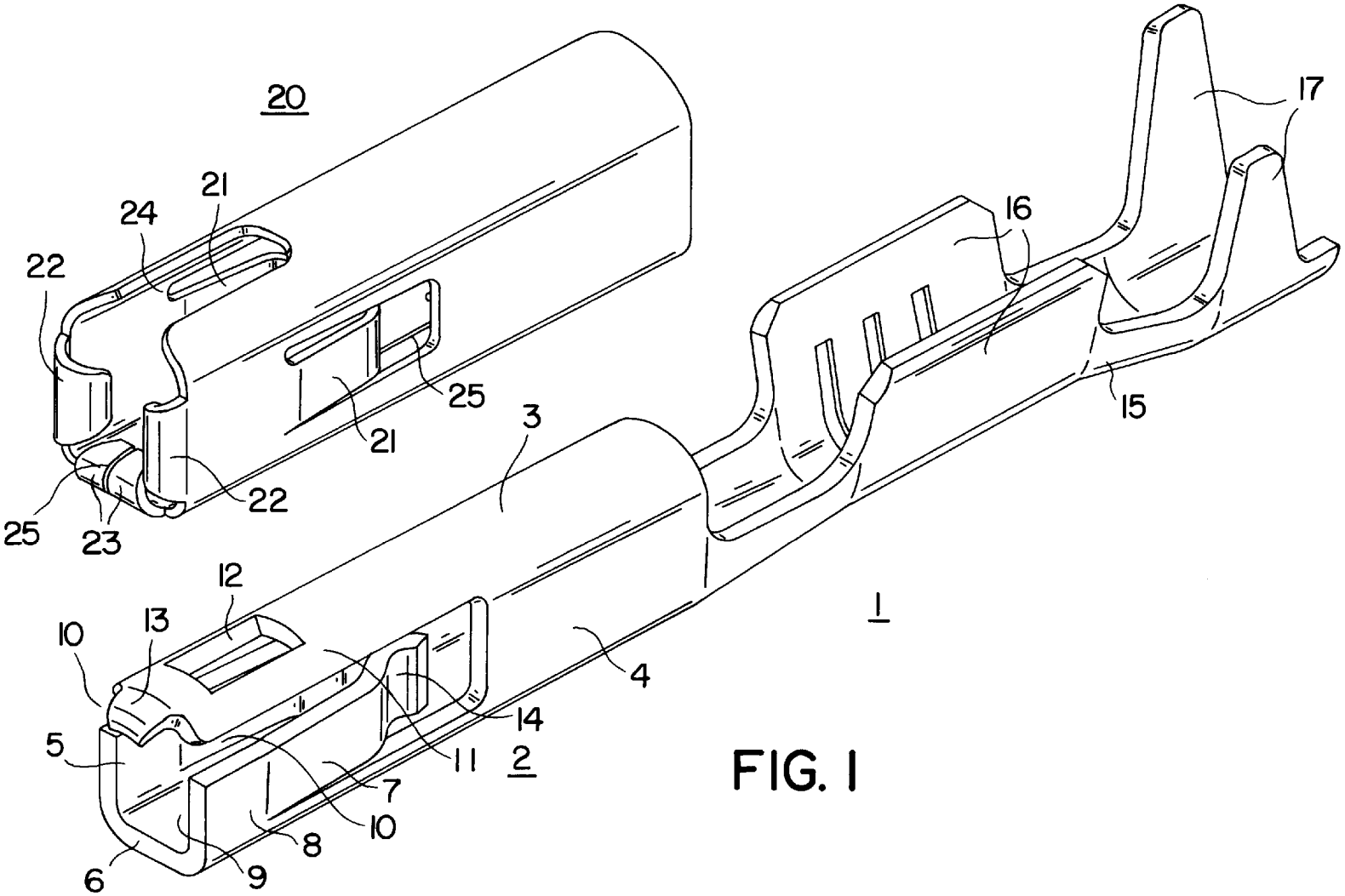
FIG. 1 shows a contact bush according to the invention and an associated sleeve, separated therefrom.

FIG. 1 shows a perspective view of a contact bush 1 according to the invention with an associated sleeve 20. The contact bush 1 comprises a box 2 and a connection section 15 with two pairs of crimping vanes 16, 17 for clamping in a conductor or its insulation. The box 2 comprises a convexly curved upper wall 3, two side walls 4 and 5 and a base 6 which together form a box with a cross-section similar to that of a tunnel or of a railway car. In the front region of each of the side walls 4, 5, a contact spring 7 is punched out and extends from a connection region 8 in the vicinity of the front end or of the plugging-in opening 9 of the box as far as a free end which lies approximately half way along the length of the box. The upper wall 3 is separated from the contact spring 7 and its connection region 8 on both sides by a gap 10 and thus forms a tongue 11 which can be flexibly pressed downwards until its edges abut the edges of the contact regions 8 or of the contact springs 7. The width of the gap 10 is therefore dimensioned such that plastic deformation of the tongue 11 is ruled out. The tongue 11 has in the vicinity of its free end a first latching element in the form of a window 12 which is provided in order to receive a lug of a plug-in connector body and thus hold the contact element 1 non-displaceably in the body. The tongue 11 also has at its free end a downwardly inclined sloping surface 13, of whose function more details will be given later.

The sleeve 20, like the contact bush 1, is formed in one piece from a sheet of metal and has an upper wall, two side walls and a base. Punched out from the side walls of the sleeve are auxiliary springs 21 whose inwardly curved tips each engage in a concave section 14 of the contact springs and, in this way, support the contact springs 7 when they are spread apart by an inserted contact pin. The longitudinal edges of the sleeve are rounded. The side walls and the base each have at their front ends curved fingers 22 and 23 which are rounded on the outside, engage in the plugging-in opening 9 of the box 2 and conceal the punched edges at the front end of the box. The contact bush with fitted-on sleeve therefore has no sharp edges and can safely be pushed through a seal which may be provided on the plug-in connector.

Figure 2:
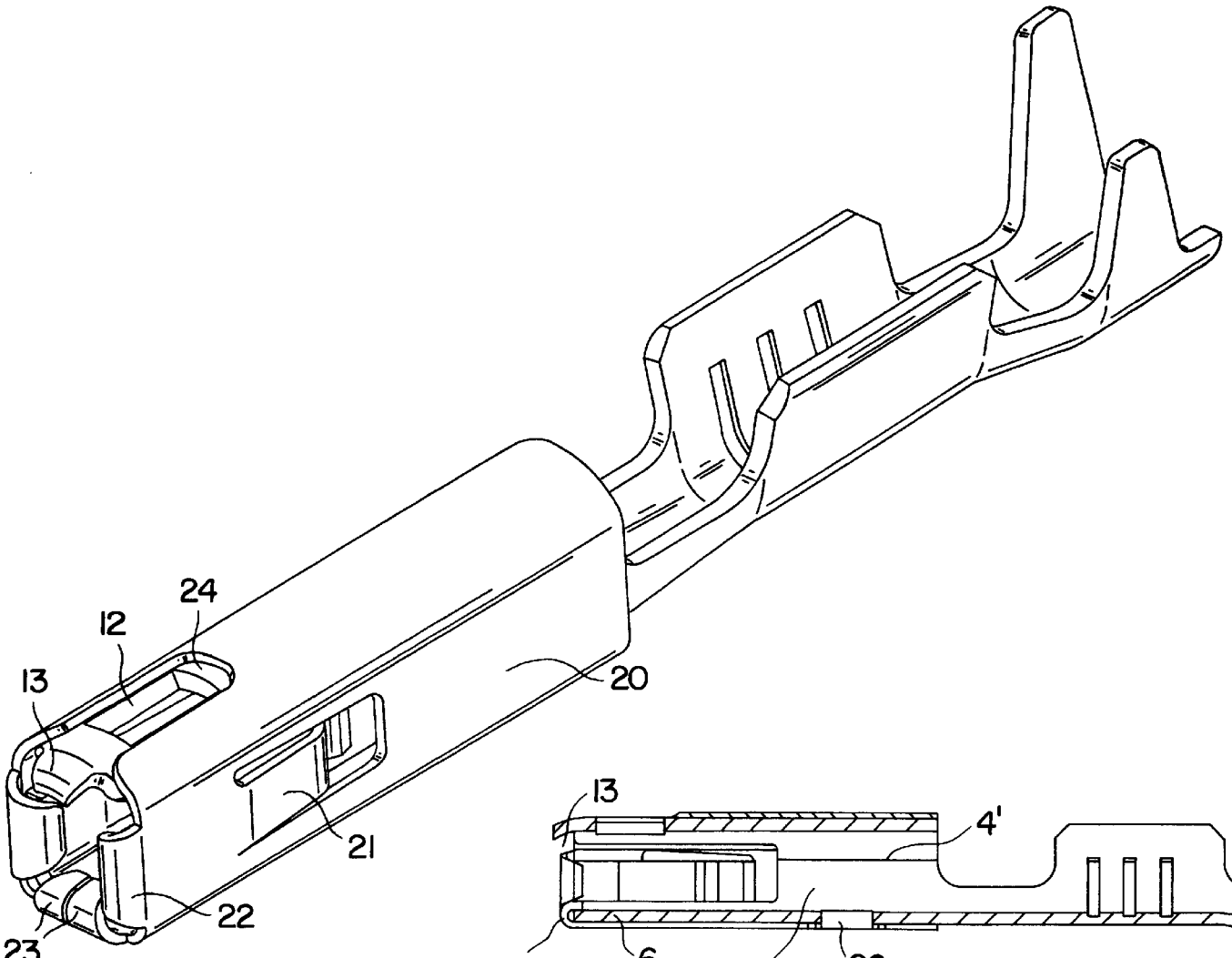
FIG. 2 shows the contact bush and the sleeve of FIG. 1 in the plugged-together state.

FIG. 2 shows the contact bush and the sleeve in the plugged-together state. The window 12 of the flexible tongue 11 is freely accessible through a cut-out 24 in the upper wall of the sleeve 20. The width of the cut-out 24 corresponds approximately to that of the window 12. The edges of the tongue 11 which bound the gap 10 are covered by the upper wall of the sleeve in order to prevent the tongue catching when it is being plugged into a chamber of a plug-in connector body and being damaged or damaging a seal when it is being pushed through it. In order to avoid the latter result, the corners of the cut-out recess 24 are also rounded.

Figure 3:
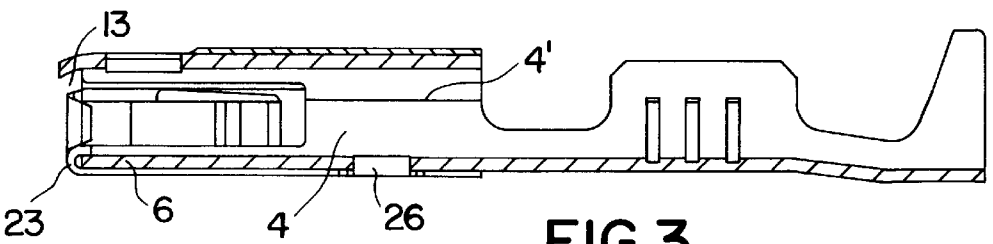
FIGS. 3 and 4 show the contact bush with the sleeve of FIG. 2 in a vertical and a horizontal longitudinal section, respectively.

FIG. 3 shows the contact bush of FIG. 2 in vertical section along its longitudinal axis. Since the box 2 is formed by bending a flat blank into an enclosed shape, two edges of the blank abut on the side wall 4 along the line 4'. The sleeve 20 tightens round the box and has integral side walls, preventing the box from being spread apart at this point. Although the sleeve 20 is manufactured by bending a flat blank, the edges of the blank abut along a line 25 (see FIG. 1) which extends between the two fingers 23 and along the base of the sleeve. On each edge of the sleeve along the line 25, there is an attachment knob 26 which is pushed into an opening 18 in the base 6 when the sleeve 20 is being installed on the box 2, and is formed by two indents.

The length of the knobs is not significantly greater than the thickness of the base 6, so the knobs do not engage destructively in the interior of the box 2. The width of the knobs 26 corresponds to the length of the opening 18 (see also FIG. 4). The sleeve 20 is held non-displaceably on the box 2 in the plugging direction by means of the knobs 26. Furthermore, together with the fingers 23, they prevent the sleeve 20 from being spread apart. This thus produces a very stable and loadable box structure without the adjoining edges of the box 2 having to be permanently connected to one another.

Figures 4, 5:
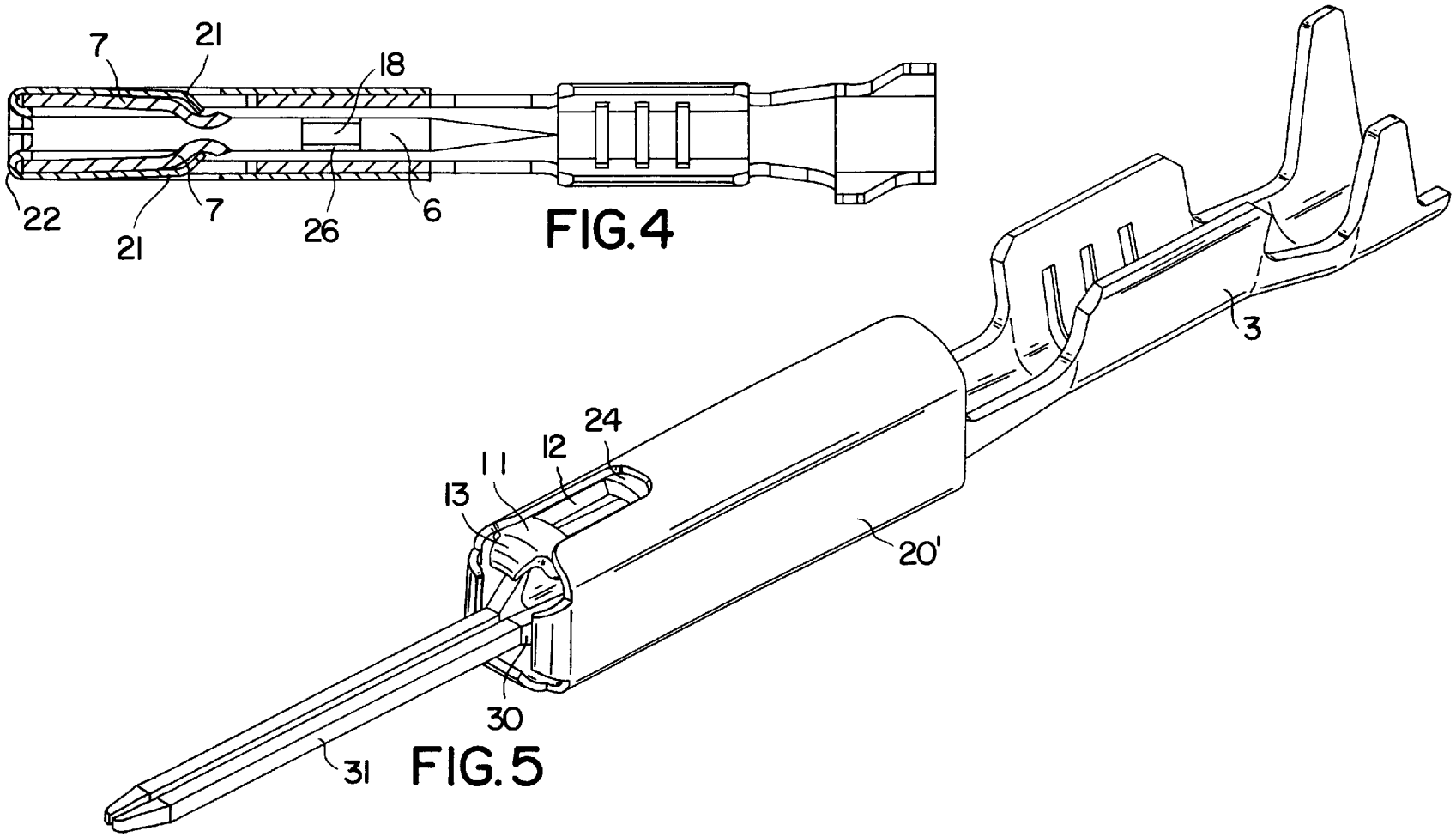
FIG. 5 shows a plug according to the invention.

FIG. 4 shows the contact bush of FIG. 2 in a horizontal section. The curved fingers 22 on the side walls of the sleeve 20 engage tightly around, essentially free of play, the connection sections 8 of the spring tongues 7. As a result, they prevent the connection sections 8 from moving out laterally when a contact pin is plugged in, and thus contribute effectively to the rigidity of the contact springs.

FIG. 5 shows a plug according to the invention with a fitted-on sleeve 20' in a perspective view. The plug comprises, as does the contact bush 1, a connection section 3 under the box section which, precisely like the box section 2 of the contact bush, has an upper wall with a flexible tongue 11, two side walls and a base. The side walls are enclosed, precisely like those of the sleeve 20'. Towards the front, they are lengthened by convergent sections 30 and adjoining needle-shaped projections 31 which are in contact with one another and are connected to one another to form a contact pin.

The shape of the flexible tongue 11 with window 12 and sloping surface 13, as well as the cut-out 24, is the same as described with respect to FIGS. 1 and 2 for the contact bush.

Figure 6:
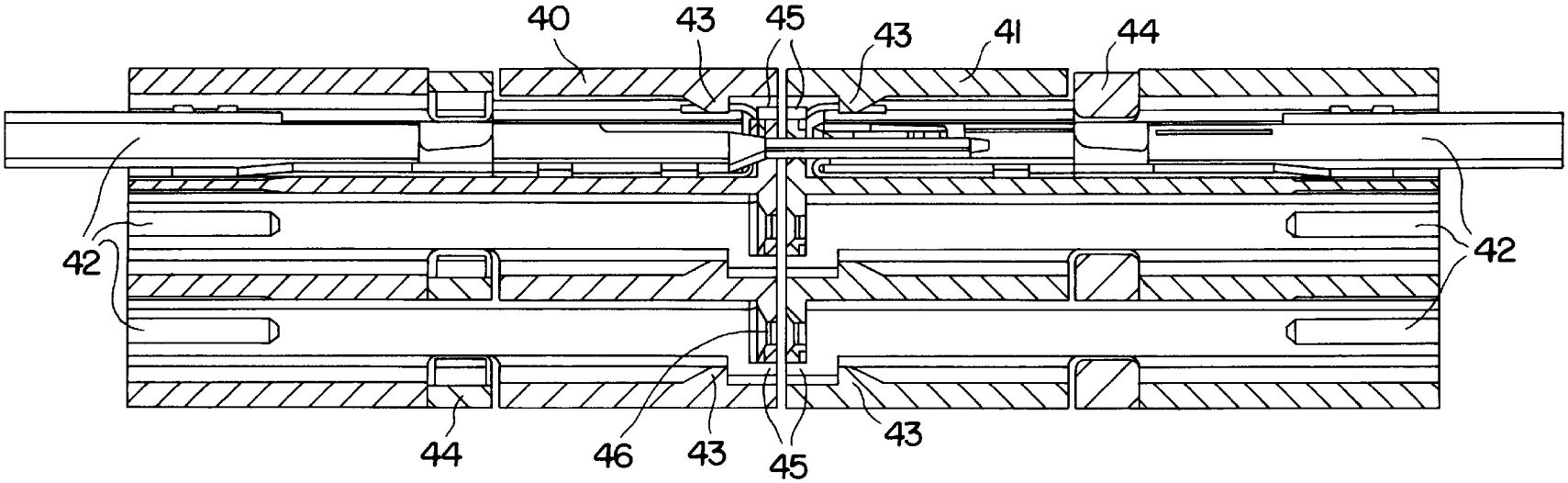
FIG. 6 shows a complete plug-in connection according to the invention.

FIG. 6 shows in section a complete plug-in connection with two identical plug-in connector bodies 40, 41 with a multiplicity of chambers 42, three of which can be seen in section in each case and where in each case an inventive contact element, a plug on the left and a bush on the right, are illustrated only in the top chambers. During assembly, the contact elements are pushed from the cable outlet side into the chambers 42 until their sloping surface 13 strikes a lug 43 which is arranged rigidly on one wall of the chamber. The cross-section of the chambers is tunnel-shaped corresponding to the cross-section of the contact elements so that they can only be inserted in an orientation in which it is ensured that the sloping surface 13 actually strikes a lug. If the contact element is inserted further, the tongue is pressed downward by the lug 43 and slides along under it until the lug is located opposite the window 12. At this moment, the tongue snaps up and the lug and window form a latching connection so that the contact element can no longer readily be pulled out of the connector body. In order to secure it additionally, lockable bars 44 may be provided, in a known fashion, in the plug-in connector body 40, 41 transversely with respect to the plugging direction, the bars 44 being able to engage in a tapered portion of the contact element between its box and the connection section in order to secure it additionally.

A passage 45, in the form of a parallel cut-out next to each contact pin through-opening 46, which opens on to the contact side of the plug-in connector body, is provided for each chamber 42 in the plug-in connector bodies. Through this passage, it is easily possible to press with a simple tool, for example a screwdriver, on to the sloping surface 13 of the contact element and in this way release the latching connection. It can then be conveniently pulled out of the chamber without the risk of damage and re-attached at any other location. Since the passage 45 is designed as a cut-out which is separated from the chamber 42 and the opening 46, the tool is reliably guided on to the sloping surface 13 and prevented from sliding off and, for example, damaging the contact springs in the interior of a bush. Since the sloping surface is made of metal, it can be actuated many times without risk of damage, so that a complicated error can be eliminated in the course of several attempts. In this way, errors during fitting can be eliminated in an extremely short time and with minimum effort.

What is claimed is:

1. A contact element having a front box section for insertion into a chamber of a plug-in connector body, and a rear connection section to which an electric lead can be attached, the front box section having a first latching element which can make a latching connection with a complementary second latching element of the plug-in connector body, in order to hold the contact element non-displaceably in the body, wherein the first latching element is arranged in a flexible tongue of the front box section which can be moved perpendicularly with respect to a plugging-in direction, in order to release the latching connection between said first and second latching element, and wherein the tongue extends in a plugging-in direction and has a free end approximately at a front end of the front box section, and the first latching element is a window adapted to receive a lug of said connector body therein.

2. The contact element according to claim 1, wherein the tongue is curved about an axis parallel to its longitudinal direction.

3. The contact element according to claim 1, wherein the tongue has at its free end a sloping surface which extends forward and inward.

4. The contact element according to claim 1, wherein the tongue is disposed on an upper wall of the front box section, and two side walls of the front box section are lengthened beyond its front end in order to form a contact pin.

5. The contact element according to claim 1, wherein the front box section comprises a box which is unitary with the connection section, and a sleeve which is plugged onto the box, the tongue being arranged on the box, and the sleeve having in a region thereof located opposite the tongue a cut-out through which the latching elements can engage.

6. The contact element according to claim 5, wherein the cut-out is narrower than the tongue.

7. The contact element according to claim 5, wherein the corners of the sleeve are rounded.

8. The contact element according to claim 5, wherein auxiliary springs which support the contact springs are formed on the side walls of the sleeve.

9. The contact element according to claim 5, wherein the sleeve has curved fingers which engage in the plug-in opening of the contact bush.

10. The contact element according to claim 1, wherein it is a contact bush.

11. The contact element according to claim 10, wherein the tongue is disposed on an upper wall of the front box section, and contact springs for clamping in a pin inserted into the bush are disposed on two side walls of the front box section.

12. The contact element according to claim 11, wherein the contact springs are produced by means of a substantially U-shaped punched element, a part of the U extending between a side wall and one upper wall being lengthened as far as the front end of the front box section in order to cut free the tongue.

13. A plug-in connector having a body in which at least one contact element according to claim 1 is received in a chamber, wherein the body has a passage through which a tool can be pressed onto the tongue in order to release the latching connection between said first and second latching element.

14. The plug-in connector according to claim 13, including a passage adapted to guide a tool onto the sloping surface.

15. The plug-in connector according to claim 14, wherein the passage opens on a contact side of the body adjacent to a through-opening for a contact pin, separately therefrom.

16. The plug-in connector according to claim 14, wherein the second latching element is rigidly connected to the body.

* * * * *